United States Patent [19]

Rao et al.

[11] Patent Number: 4,494,375

[45] Date of Patent: Jan. 22, 1985

[54] FILTRATION SYSTEM FOR DIESEL ENGINE EXHAUST-I

[75] Inventors: Vemulapalli D. N. Rao, Bloomfield Township, Oakland County; Wallace R. Wade, Farmington Hills, both of Mich.

[73] Assignee: Ford Motor Company, Dearborn, Mich.

[21] Appl. No.: 463,688

[22] Filed: Feb. 3, 1983

[51] Int. Cl.[3] ..... F01N 3/02

[52] U.S. Cl. ..... 60/296; 55/283; 55/314; 55/344; 55/DIG. 10; 55/DIG. 30; 60/303; 60/311

[58] Field of Search ..... 60/296, 303, 311; 55/283, 344, DIG. 30, 314, DIG. 10

[56] References Cited

U.S. PATENT DOCUMENTS

| | | | |
|---|---|---|---|
| 4,281,512 | 8/1981 | Mills | 55/DIG. 30 |
| 4,373,330 | 2/1983 | Stark | 55/DIG. 30 |
| 4,404,795 | 9/1983 | Oishi | 55/DIG. 30 |
| 4,427,418 | 1/1984 | Kogiso | 55/DIG. 30 |

FOREIGN PATENT DOCUMENTS

| | | | |
|---|---|---|---|
| 132416 | 10/1981 | Japan | 60/296 |
| 79211 | 5/1982 | Japan | 60/296 |

*Primary Examiner*—Douglas Hart

*Attorney, Agent, or Firm*—Joseph W. Malleck; Olin B. Johnson

[57] ABSTRACT

A filtration system is disclosed which removes particulates from the exhaust gas of a diesel engine. The system has (a) a filter element, (b) oxidation means for conducting a flow of heated gas through at least a portion of the filter element, the heated gas being effective to ignite the particulates in that portion, and (c) a flow control means. The flow control means has walls dividing the filter element into first and second portions, and a flow diverter effective to normally permit full exhaust gas flow through both of said filter portions, and effective to selectively permit exhaust glow through only one of the filter portions while permitting flow of heated gas of the oxidation means through the other of said filter portions.

12 Claims, 1 Drawing Figure

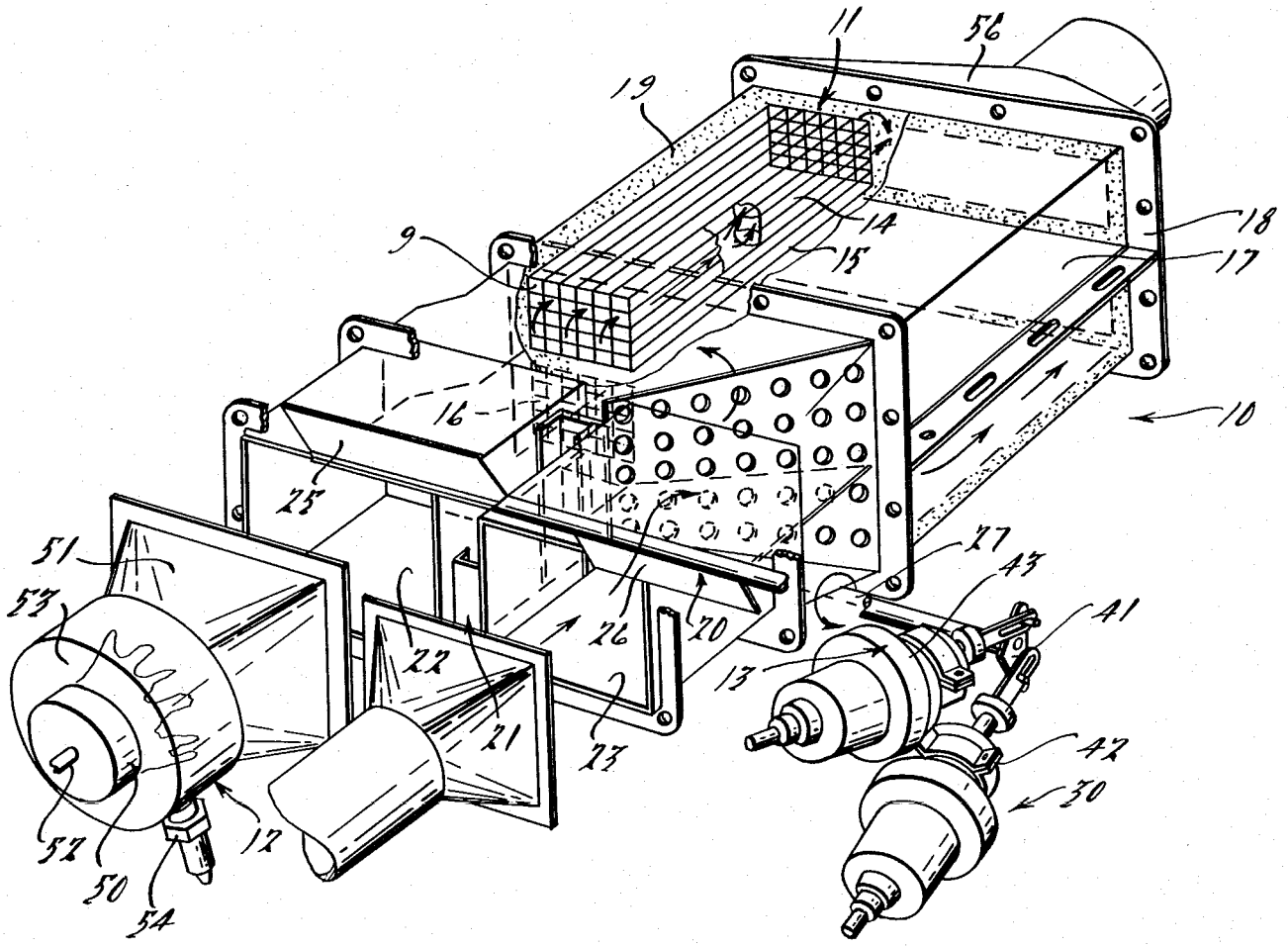
10
11
12
13
14
15
16
17
18
19
20
21
22
23
25
26
27
30
41
42
43
50
51
52
53
54
56

FILTRATION SYSTEM FOR DIESEL ENGINE EXHAUST-I

BACKGROUND OF THE INVENTION AND PRIOR ART STATEMENT

The state of the art engine technology may allow a diesel engine to emit as low as 0.6 gm/mile particulates. However, with more stringent particulate emission requirements to come into effect in 1985 (such as at a level of 0.20 gm/mile) the technology cannot meet such lower level of particulate emissions without some form of particulate trap. The most important materials used to date by the prior art for the trap material have included rigid and fibrous ceramic material (see U.S. Pat. No. 4,276,071) and wire mesh, each material having its own characteristic mode of trapping. Some of these materials have been coated with catalysts to facilitate incineration, but the placement of the coating as a layer throughout the filter does not lower incineration temperature effectively and produces unwanted sulphates.

The particulates emitted and trapped throughout the life of a vehicle cannot be stored since the amount can be typically 20 $ft^3$ for each 100,000 miles. As the particulates build up, exhaust system restriction is increased. Thus a means is required to remove the trapped material periodically. The most effective method found to date is thermal oxidation of the carbonaceous particles which incinerate at about 1200° F. (600° C.).

Normal diesel engine exhaust temperatures rarely reach 1100° F. (600° C.) during normal driving. Therefore, an auxiliary temperature elevating means is necessary to carry out thermal oxidation. The types of thermal oxidation means have generally fallen into the following categories: a fuel fed burner (U.S. Pat. No. 4,167,852 and Japanese Pat. No. 55-19934), an electric heater (see U.S. Pat. Nos. 4,270,936; 4,276,066; 4,319,896), or detuning techniques (which may be combined with the above) for raising the temperature of the exhaust gas temperature at selected times (see U.S. Pat. Nos. 4,211,075; 3,499,269). These techniques have been used to burn the collected particles in the presence of excess oxygen.

In all cases where regeneration means have been used by the prior art, the operation of the system has utilized the trap material in line during the regeneration cycle with no interruption of exhaust flow through the filter material (see U.S. Pat. Nos. 4,257,225 and 4,167,852), or has totally bypassed about the trap material by sending the exhaust gases around the trap to remain untreated during the regeneration of the trap material (see Japanese Pat. No. 55-19934, 1908).

With respect to the mode of regeneration where the trap material is in line, it has proven to be disadvantageous because of the excessive amount of energy required to raise the temperature of the total exhaust flow to the desired temperature for regeneration, and because the total trap is not used during normal operation. With respect to the bypass configuration of the prior art, it has proven to be disadvantageous because (a) no trapping takes place during the regeneration cycle, (b) the total trap material being not used during the normal trapping mode, and (c) additional exhaust silencing means may be required during regeneration.

Therefore, what is needed is a filtration system which has an operative mode of regeneration that (1) allows use of the entire filter material during trapping and regeneration, (2) reduces the energy required to regenerate by restricting the energy input to that which is necessary to ignite the collected particles and thereafter allowing the exothermic reaction to propogate and continue without further energy input, and (3) allows the use of simpler controls which operate independent of the engine operation.

SUMMARY OF THE INVENTION

The invention is a filtration system operative to remove particulates from the exhaust gas of a diesel engine. The system is arranged to use the total filter material during both nonregeneration periods as well as during regeneration periods. The exhaust gas is constantly being filtered by the trap material. Less energy is required during the regeneration mode by use of an ignition system that raises the temperature of the front face of the filter trap to the required ignition temperature and thereafter shuts off, allowing the flame to propogate throughout the trap material by its own exothermic reaction.

The filtration system comprises (a) a filtration means having a filter element operative to filter out and collect a substantial portion of the entrained particulates in the exhaust gas, (b) an oxidation means for conducting a flow of heated gas through at least a portion of the filter element effective to ignite the particulates in that portion, and (c) a flow control means which has walls dividing the filter element into first and second portions and has a flow diverter effective to normally permit full exhaust gas flow through both of said filter portions, and effective to selectively permit exhaust flow through only one of the filter portions while permitting flow of heated gas of the oxidation means through the other of said filter portions.

The heated gas of said oxidation means may be constituted of atmospheric air into which fuel droplets are sprayed and ignited by a sparking device, glow plug, or electric heating element. Alternatively, the heated gas may be preferably constituted of a diverted portion of the exhaust gas to which may be added fuel and thence combusted to raise the temperature thereof.

It is preferable that the divided portions of said filter material be generally equal in volume and the divided portions be sized so that regeneration may take place during a period from 1–8 minutes of operation of the engine (during such period substantially all of the particulates are oxidized). Advantageously, the filter material has an average total volume capacity of 0.8 to 2.5 times engine displacement so that the normal collection of particles is in the range of 100–250 $mg/in^3$ and may be oxidized within a regeneration period of 1–8 minutes.

It is preferable if the heated gas is heated by a source of energy only during a period necessary to effectuate ignition of the particulates in the trap at the frontal face of the filter. Once a flame front has been established in the particles of the trap, the flame propogates along the collection of particles and creates its own appropriate temperature by its inherent exothermic reaction with the excess oxygen of the heated gas. It is desirable that the heated gas have a flow during regeneration which is about 2–40 CFM (cubic feet per minute), and the exhaust gas flow should be preferably in the range of 30–90 CFM, although the system function is independent of the engine speed and flow. The lower flow will reduce the excessive back pressure due to halving the filter flow cross section. It is desirable if the temperature of the exhaust gases, passing through the filter during the period of operation of said engine is as high as possible, 350°-500° F.; however, the system can function with temperatures as low as 150° F.

The control means preferably comprises a plenum having two separate ducts, each duct communicating with both the filter portions, one duct receiving the heated gas and the other duct receiving the exhaust gas. The control means further comprises a valve means having a pair of valves carried on a common positioning support. Each of said valves is associated with each of said ducts and arranged to operate opposite the other. Thus, with the positioning support in a first position, the heated gas is free to pass into a first portion of the filter, while the heated gas is free to pass into the second portion of the filter. In a second inverted position of the positioning support, the heated gas is free to pass into the second portion of the filter means while the exhaust gas is free to pass into the first portion of the filter means. Advantageously the flow diverter is moved between first and second positions by solenoid actuated cranks.

SUMMARY OF THE DRAWINGS

The FIGURE is a perspective view of a preferred mode of this invention, the view showing certain of the housing walls in phantom so as to give an interior view of the assembly.

DETAILED DESCRIPTION

As shown in the FIGURE, a preferred filtration system 10 of this invention comprises broadly a filtration means 11, an oxidation means 12, and a flow control means 13. The filter means 11 has a filter element 14 operative to filter out and collect a substantial portion of the entrained particles in the exhaust gas that is permitted to flow therethrough. The element may preferably be comprised of rigid or fibrous ceramic such as aluminum silicate or mullite aluminum titanate or cordierite. In any case, the ceramic material is formed in a honeycomb structure in a well known manner (see reference SAE 810114). The filter element is divided into a first portion 15 and a second portion 16 by way of a horizontal wall 17. The divided portions are encased in a housing 18, all of said walls being formed preferably of stainless steel. The filter element is separated from the housing wall by a shell of insulation 19. It is preferable that the filter element have an average internal volume of 100-225 $in^3$, and a frontal face area 9 of about 15-25 $in^2$ in case of a 2.3 liter engine. It is advantageous to coat the ceramic filter element with an oxidation catalyst, such as finely dispersed platinum or palladium, up to approximately 1-2 inches from inlet face, to facilitate soot light off. The mode of entrapment of such honeycomb ceramic filters is by way of interception; particulates larger than approximately the mean pore size of the material are intercepted and prevented from passing through the material. The art of making such trap materials is more fully described in SAE 810114 and SAE 810118, which descriptions are incorporated herein by reference.

The flow control means 13 has wall 17 dividing the filter element into two portions and has a flow diverter 20 which is effective to normally permit the full exhaust gas flow through both of the filter portions 15 and 16, and also effective to selectively permit the exhaust flow through only one of the filter portions (such as 15) while permitting flow of heated gas from the oxidation means through the other of said filter portions (such as 16).

More particularly, the flow control means has an entrance of plenum 21 with two separate ducts 22 and 23, each communicating with both of the filter portions 15 and 16. One of the ducts 22 receives heated gas and the other duct 23 receives exhaust gas. The flow control means has valve means 24 provided with a pair of valves 25 and 26 carried on a common positioning support 27. One each of the valves (25,26) is associated with each of the ducts (22,23) and is arranged to operate opposite of the other.

Thus, when the positioning support 27 is in a first position (such as shown in the FIGURE), the heated gas is free to pass into the first portion 16 of the filter, while the exhaust gas is free to pass into the other filter portion 15. In the second inverted position of the positioning support, the heated gas is free to pass into the portion 15 of the filter means, while the exhaust gas is free to pass into portion 16 of the filter.

The actuator 30 for the positioning support comprises a crank 41 and a pair of solenoid actuators 42, 43 connected to different locations on the crank arm 41. Thus, when one of the solenoids is actuated the positioning support is rotated in one direction, and when the other is operated, to the exclusion of the first solenoid, the positioning support is rotated in the opposite direction.

The oxidation means 12 particularly comprises, in the case of the preferred embodiment, a burner 50 which is supported in a transition duct work 51 leading to the duct 22 of the plenum 21. The burner is effective to supply energy to the flow of air therethrough, the energy being supplied long enough for the heated gas to achieve a temperature of 1050°-1450° F. and thereby ignite the front face of the filter element. When the ignition of the particles on the front face of the filter element occurs and combustion is stabilized, the necessity for further energy input to the oxidation means is unnecessary because the flame will propogate throughout the length of the filter consuming the particles therealong and producing its own heat for propogation as a result of an exothermic reaction.

The burner in particular comprises a supply of diesel fuel through a conduit 52, a nozzle 53 through which the fuel is sprayed, and a sparking device 54 for igniting the air/hydrocarbon atomized mixture. Other suitable conduits 55 may be employed for conducting the heated exhaust gas from the engine to the plenum duct 23, and transition duct work 56 may be employed at the exit of the trapping device to conduct the exhaust gases to a release station.

We claim:

1. A filtration system operative to remove oxidizable particulates from the exhaust gas of a diesel engine, comprising:

(a) filtration means having a filter element operative to filter out and collect a substantial portion of the entrained particulates in the exhaust gas;

(b) oxidation means for conducting a flow of gas, heated by a source of energy, through at least a portion of said filter element and effective to ignite said particulates in that portion; and (c) flow control means having walls dividing said filter element into first and second portions, and having a flow diverter effective to normally permit full exhaust gas flow through both of said filter portions, and simultaneously effective to selectively permit exhaust gas flow through only one of said filter portions while permitting flow of heated gas of said oxidation means through the other of said filter portions.

2. The filtration system as in claim 1, in which said oxidation means deploys a heated gas only during a period to effectuate ignition of the particulates at the front face of said filter portion, said heating by said source of energy being terminated thereafter.

3. The filtration system as in claim 1, in which said divided portions are generally equal.

4. The filtration system as in claim 1, in which said gas of said oxidation means is comprised of a combustible mixture of atmospheric air and hydrocarbon fuel, said mixture being heated by burning and which heated mixture in turn ignites the particles collected in said filter.

5. The filtration system as in claim 1, in which said gas is comprised of hot exhaust gas from said diesel engine to which is added additional hydrocarbon fuel to form a mixture, said mixture being heated by combustion.

6. The filtration system as in claim 1, in which said oxidation means is effective to oxidize substantially all of the particles in a filter portion during a period of 1–3.5 minutes.

7. The filtration system as in claim 1, in which said flow control means comprises:

(i) a plenum having two separate ducts, each communicating with both said filter portions, one duct receiving a flow of heated gas and the other duct receiving a flow of said exhaust gas;

(ii) valve means having a pair of valves carried on a common positioning support, one each of said valves being associated with each of said ducts and arranged to operate opposite of the other, whereby with the positioning support in a first position the heated gas is free to pass into the first portion of said filter element while said exhaust gas is free to pass into the second portion of said filter element, and in a second inverted position of said positioning support the heated gas is free to pass into said second portion of said filter means while said exhaust gas is free to pass into the first filter portion.

8. The filtration system as in claim 7, in which the filter element is ceramic and is honeycomb shaped.

9. The filtration system as in claim 7, in which said control means has solenoid actuated cranks to move said flow diverter between first and second positions.

10. The filtration system as in claim 7, in which the flow of heated gas during regeneration is about 2–40 CFM, and the exhaust gas flow is in the range of 30–150 CFM.

11. The filtration system as in claim 1, in which the back pressure during nonregenerative operation is no greater than 80 inches or water or 6 inches of mercury.

12. The filtration system as in claim 1, in which the temperature of the gases passing through said filter element during the period of operation of said engine does not drop below 150° F.

* * * * *